US009426869B2

(12) United States Patent
Chou et al.

(10) Patent No.: US 9,426,869 B2
(45) Date of Patent: Aug. 23, 2016

(54) MULTI-OUTPUT ELECTRONIC BALLAST

(75) Inventors: Ching-Ho Chou, Taoyuan Hsien (TW); Yung-Chuan Lu, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 457 days.

(21) Appl. No.: 13/231,337

(22) Filed: Sep. 13, 2011

(65) Prior Publication Data

US 2012/0248980 A1 Oct. 4, 2012

(30) Foreign Application Priority Data

Mar. 28, 2011 (TW) ..... 100110667 A

(51) Int. Cl.
*H05B 37/02* (2006.01)
*H05B 41/28* (2006.01)
*H05B 41/295* (2006.01)

(52) U.S. Cl.
CPC ..... *H05B 41/28* (2013.01); *H05B 41/295* (2013.01)

(58) Field of Classification Search
CPC H05B 41/2828; H05B 41/046; H05B 41/28; H05B 41/245
USPC ..... 315/226
See application file for complete search history.

(56) References Cited

U.S. PATENT DOCUMENTS 3,603,841 A * 9/1971 Yamada et al. ..... 315/171
3,771,013 A * 11/1973 Roche et al. ..... 315/101
6,121,733 A * 9/2000 Nilssen ..... 315/224
6,232,726 B1 * 5/2001 Janczak ..... 315/224
6,922,023 B2 * 7/2005 Hsu et al. ..... 315/291
7,109,659 B2 * 9/2006 Kamoi ..... 315/88
7,141,937 B2 * 11/2006 Kumagai et al. ..... 315/224
7,285,925 B2 * 10/2007 Chen et al. ..... 315/312
7,449,846 B2 * 11/2008 Nicolai ..... 315/309
2002/0011806 A1 * 1/2002 Moisin ..... 315/291
2002/0149954 A1 * 10/2002 Besnier et al. ..... 363/123
2004/0004450 A1 * 1/2004 Hsu et al. ..... 315/291
2004/0124783 A1 * 7/2004 Moon ..... 315/224

(Continued)

OTHER PUBLICATIONS

'Regulated Power Supplies', Third Edition, Irving M. Gottlieb, SAMS, 1986.*
Gottllieb, Irving: 'Regulated Power Supplies', pp. 346-347, SAMS Third Edition, Gottlieb, Irving, 1986.*

*Primary Examiner* — Tuyet Vo
*Assistant Examiner* — Amy Yang
(74) *Attorney, Agent, or Firm* — Kirton McConkie; Evan R. Witt

(57) ABSTRACT

A multi-output electronic ballast is disclosed. The multi-output electronic ballast is used to drive a plurality of lamp assemblies and includes an AC/DC converter, a first inverter, a second inverter, an auxiliary voltage generator, and a control circuit. The AC/DC converter converts an AC input voltage to a high DC voltage. The first inverter converts the high DC input voltage to a first AC voltage selectively. The second inverter converts the high DC voltage to a second AC voltage. The auxiliary voltage generator generates an auxiliary voltage. The control circuit receives the auxiliary voltage generating circuit and outputs a control signal to the first inverter according to the switching operation of a first external switch. When the control signal is transmitted to the first inverter, the first inverter comes into operation and converts the high DC voltage to the first AC voltage.

13 Claims, 3 Drawing Sheets

(56) References Cited

U.S. PATENT DOCUMENTS

2004/0155603 A1* 8/2004 Clegg ..... 315/291
2005/0105305 A1* 5/2005 Sawada et al. ..... 363/34
2006/0108940 A1* 5/2006 Kamoi ..... 315/209 R
2008/0111496 A1* 5/2008 Lee et al. ..... 315/277
2009/0021174 A1* 1/2009 Feldtkeller et al. ..... 315/117
2011/0043122 A1* 2/2011 Alexandrov ..... 315/246

* cited by examiner

MULTI-OUTPUT ELECTRONIC BALLAST

FIELD OF THE INVENTION

The invention is related to an electronic ballast, and more particularly to a multi-output electronic ballast which can selectively stop outputting the output voltage.

BACKGROUND OF THE INVENTION

Illumination is the basic need for the human kind. In recent years, with the surge of the global economy and the commercial activity, the electricity utility for illumination has been boosted. Therefore, the overall demands of illumination are considerable. The low-pressure gas discharge lamp is by far the most widely used lamp. The gas discharge lamp is also known as a fluorescent lamp or a daylight lamp. Therefore, if the energy consumption of the low-pressure gas discharge lamp can be reduced efficiently, a considerable amount of electricity can be saved. With the evolvement of time and the promotion of living quality, the conventional drivers for driving illumination device have been outdated. Therefore, the electronic ballast which is featured by low electromagnetic interference, high efficiency, high power density, zero flickering, light weight, high-quality illumination, and high energy-saving performance, have become the mainstream of illumination device.

The electronic ballast used for illuminant purpose has a complex circuit structure. The conventional single-output electronic ballast includes an AC/DC converter and an inverter. In operation, the AC/DC converter converts an AC input voltage into a high DC voltage, which in turn is converted by the inverter into a high-frequency AC output voltage for driving the gas discharge lamp. The AC/DC converter may possess a power factor correction function for boosting the power factor of the electronic ballast. The inverter is able to provide illumination with high efficiency, zero flickering, and high quality through the regulation of operating frequency.

Nowadays, a vast amount of fluorescent lamps are widely used for indoor illumination in a spacious place such as a warehouse. When fluorescent lamps are used in daylight situations, outdoor situations with sufficient lighting, or indoor situations without operators, part of the fluorescent lamps may be turned off to avoid the waste of energy and save energy consumption.

To meet the goal of selectively turning off part of the fluorescent lamps, a multi-output electronic ballast has been proposed for driving two lamp assemblies. The conventional multi-output electronic ballast includes a first AC/DC converter, a second AC/DC converter, a first inverter, and a second inverter. The first AC/DC converter has a first input terminal and a first output terminal. The first output terminal of the first AC/DC converter is connected to the first inverter, and the power circuit consisted of the first AC/DC converter and the first inverter is used to drive the first lamp assembly. Likewise, the second AC/DC converter has a second input terminal and a second output terminal. The second output terminal of the second AC/DC converter is connected to the second inverter, and the power circuit consisted of the second AC/DC converter and the second inverter is used to drive the second lamp assembly.

In order to allow the user to control whether the second lamp assembly is illuminating or not, a first external switch is connected in series with the first input terminal of the first AC/DC converter and a second external switch is connected in series with the second input terminal of the second AC/DC converter. In this manner, the input voltage can be manipulated to be selectively applied to the first AC/DC converter and the second AC/DC converter by the switching operation of the first external switch and the switching operation of the second external switch. As a result, the external switches can be used to selectively turn off the fluorescent lamps.

As each power circuit for driving the lamp assembly is independent from each other, the multi-output electronic ballast must possess a plurality of AC/DC converters. Furthermore, the AC/DC converter includes a plurality of expensive electronic components. Hence, the conventional multi-output electronic ballast is bulky and expensive.

It is therefore needed to develop a multi-output electronic ballast with small size and low cost.

SUMMARY OF THE INVENTION

An object of the invention is to provide a multi-output electronic ballast with a low manufacturing cost and small size for allowing the user to selectively turn off a plurality of lamp assemblies.

To this end, a broad aspect of the invention is achieved by providing a multi-output electronic ballast for driving a plurality of lamp assemblies. The inventive multi-output electronic ballast includes an AC/DC converter connected to a second external switch and a DC bus for converting an AC input voltage into a high DC voltage through the second external switch; a first inverter connected to the DC bus for selectively converting the high DC voltage into a first AC voltage and outputting the first AC voltage to a first lamp assembly; a second inverter connected to the DC bus for selectively converting the high DC voltage into a second AC voltage and outputting the second AC voltage to a second lamp assembly; an auxiliary voltage generator for generating an auxiliary voltage; and a control circuit connected to a first external switch, the auxiliary voltage generator, and a first inverter controller of the first inverter for selectively receiving the auxiliary voltage according to the switching operation of the first external switch and outputting a control signal to the first inverter controller accordingly; wherein when the control signal is transmitted to the first inverter controller, the first inverter controller is activated to drive the first inverter to convert the high DC voltage into the first AC voltage and outputting the first AC voltage to the first lamp assembly.

Now the foregoing and other features and advantages of the present invention will be best understood through the following descriptions with reference to the accompanying drawings, wherein:

DETAILED DESCRIPTION OF THE PREFERRED EMBODIMENT

An exemplary embodiment embodying the features and advantages of the present invention will be expounded in following paragraphs of descriptions. It is to be realized that the present invention is allowed to have various modification in different respects, all of which are without departing from the scope of the present invention, and the description herein and the drawings are intended to be taken as illustrative in nature, and are not intended to be taken as a confinement to limit the invention.

Figure 1:
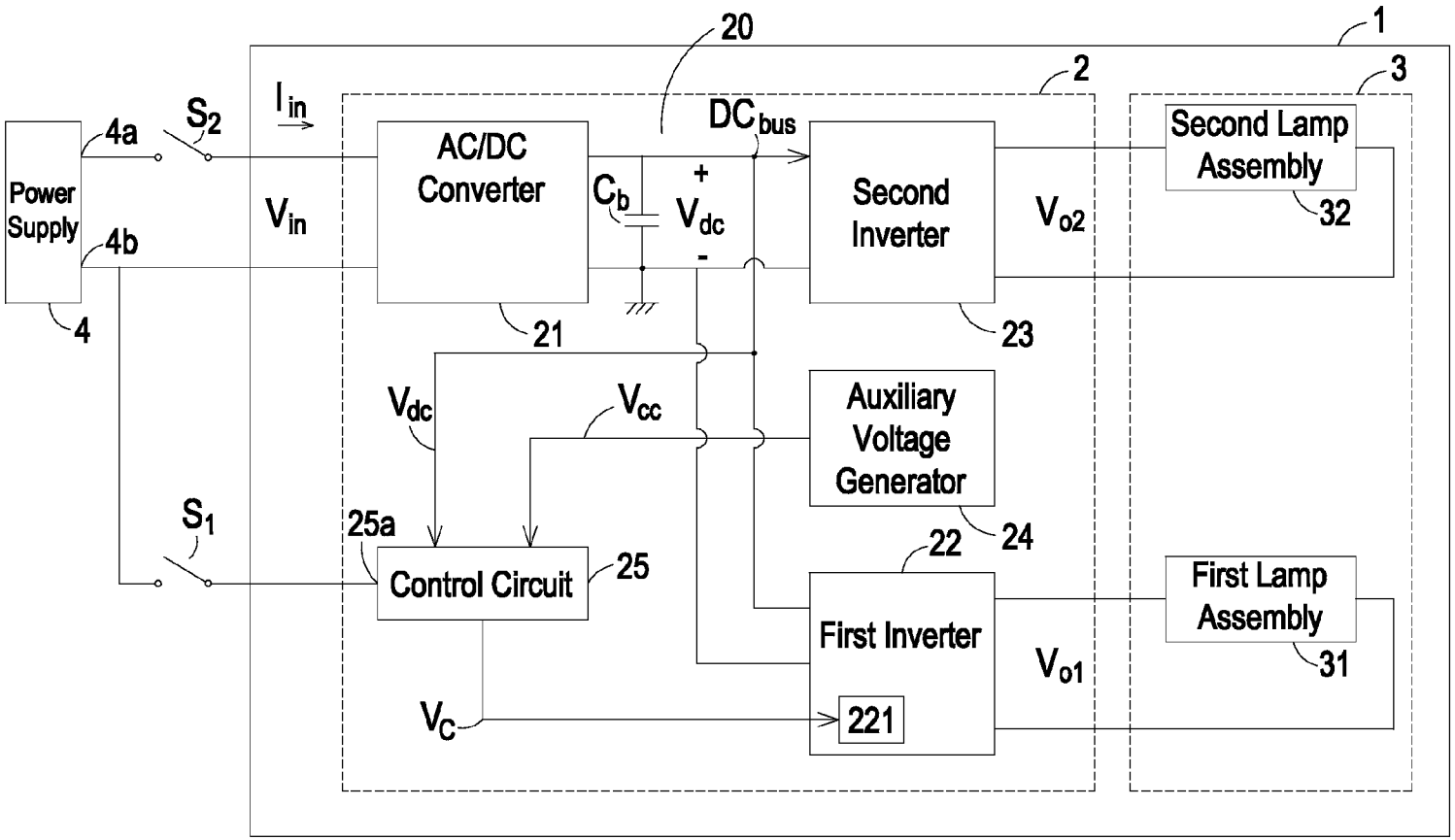
FIG. 1 is a circuit block diagram showing the circuit structure of the multi-output electronic ballast according to an exemplary embodiment of the invention.

FIG. 1 is a circuit block diagram showing a multi-output electronic ballast according to an exemplary embodiment of the invention. In FIG. 1, the multi-output electronics ballast 2 and a plurality of lamps 3 are mounted in the lamp fixture 1. The multi-output electronics ballast 2 is used to output a plurality of output voltages for driving the lamps 3 respectively. In this embodiment, the multi-output electronic ballast 2 is used to convert the AC input voltage Vin provided by the power supply 4 into a high-frequency first AC output voltage Vo 1 and a second AC output voltage Vo2. Each lamp assembly 31 or 32 includes at least one lamp. The multi-output electronics ballast 2 includes an AC/DC converter 21, a first inverter 22, a second inverter 23, an auxiliary voltage generator 24, and a control circuit 25. The input end of the AC/DC converter 21 is connected to the power supply 4, and the output end of the AC/DC converter 21 is connected to a DC bus 20. The AC/DC converter 21 is used to convert the AC input voltage Vin into a DC voltage Vdc with a voltage level of 450V, for example.

The input side of the first inverter 22 is connected to the DC bus 20 and the output side of the first inverter 22 is connected to the first lamp assembly 31. The first inverter 22 is used to selectively convert the DC voltage Vdc into a high-frequency first AC voltage Vol. The input side of the second inverter 23 is connected to the DC bus 20 and the output side of the second inverter 23 is connected to a second amp assembly 32. The second inverter 23 is used to convert the DC voltage Vdc into a high-frequency second AC voltage Vo2. The auxiliary voltage generator 24 is used to generate an auxiliary voltage Vcc with a voltage level of 15V, for example. The control circuit 25 is connected to the DC bus 20, the auxiliary voltage generator 24, and a first inverter controller 221 of the first inverter 22, and is connected to the power supply 4 through a first switch S1 which is located outside the ballast 2. The control circuit 25 is used to apply the auxiliary voltage Vcc and the DC voltage Vdc to the first inverter controller 221 to control whether the first inverter 22 is operating or not. Therefore, the first lamp assembly 31 may be selectively turned off. In this embodiment, the ballast 2 may further include a bus capacitor Cb which is connected to the DC bus 20 for filtering the DC voltage Vdc.

Referring to FIG. 1, in order to allow the user to control whether the lamp assemblies 31 and 32 are illuminating or not, the detecting terminal 25a of the control circuit 25 is connected in series with the first switch S1. Also,the input side of the AC/DC converter 21 is connected in series with a second switch S2. The ON/OFF state of the second switch S2 is used to determine whether the first inverter 22 and the second inverter 23 is operating. When the second switch S2 is turning on, the AC input voltage Vin is applied to the input side of the AC/DC converter 21 through the second switch S2. The AC/DC converter 21 converts the AC input voltage Vin into a DC voltage Vdc. The second inverter 23 converts the DC voltage Vdc into a second AC voltage Vo2 and drives the second lamp assembly 32 to illuminate accordingly.

One end of the first switch S1 is either connected to a first terminal 4*a* of the power supply 4 (the live wire) or connected to a second terminal 4*b* of the power supply 4 (the earth wire). The other end of the first switch S1 is connected to the detecting terminal 25*a* of the control circuit 25. In this embodiment, the first-switch S1 is connected to the second terminal 4*b* of the power supply 4. When the first switch S1 is turned on, the energy of the AC input voltage Vin is transmitted to the detecting terminal 25*a* of the control circuit 25, thereby allowing the control circuit 25 to output a control signal Vc to the first inverter controller 221 in response to the ON state of the first switch S1. The energy required by the control signal Vc is either provided by the auxiliary voltage Vcc and provided by the DC voltage Vdc. Under this condition, the first inverter controller 221 of the first inverter 22 drives the first inverter 22 to operate in response to the control signal Vc, thereby converting the DC voltage Vdc into the first AC voltage Vol and driving the first lamp assembly 31 to illuminate accordingly. Moreover, when lamp assemblies are employs in outdoor situations, indoor situations with sufficient lighting, or indoor situations without operators, the user may turn off the first switch Si to prevent the energy of the AC input voltage Vin from being transmitted to the detecting terminal 25*a* of the control circuit 25 through the first switch S1. The control circuit 25 will stop outputting the control signal Vc to the first inverter controller 221 in response to the OFF state of the first switch Sl, thereby ceasing the operation of the first inverter 22.

Figure 2:
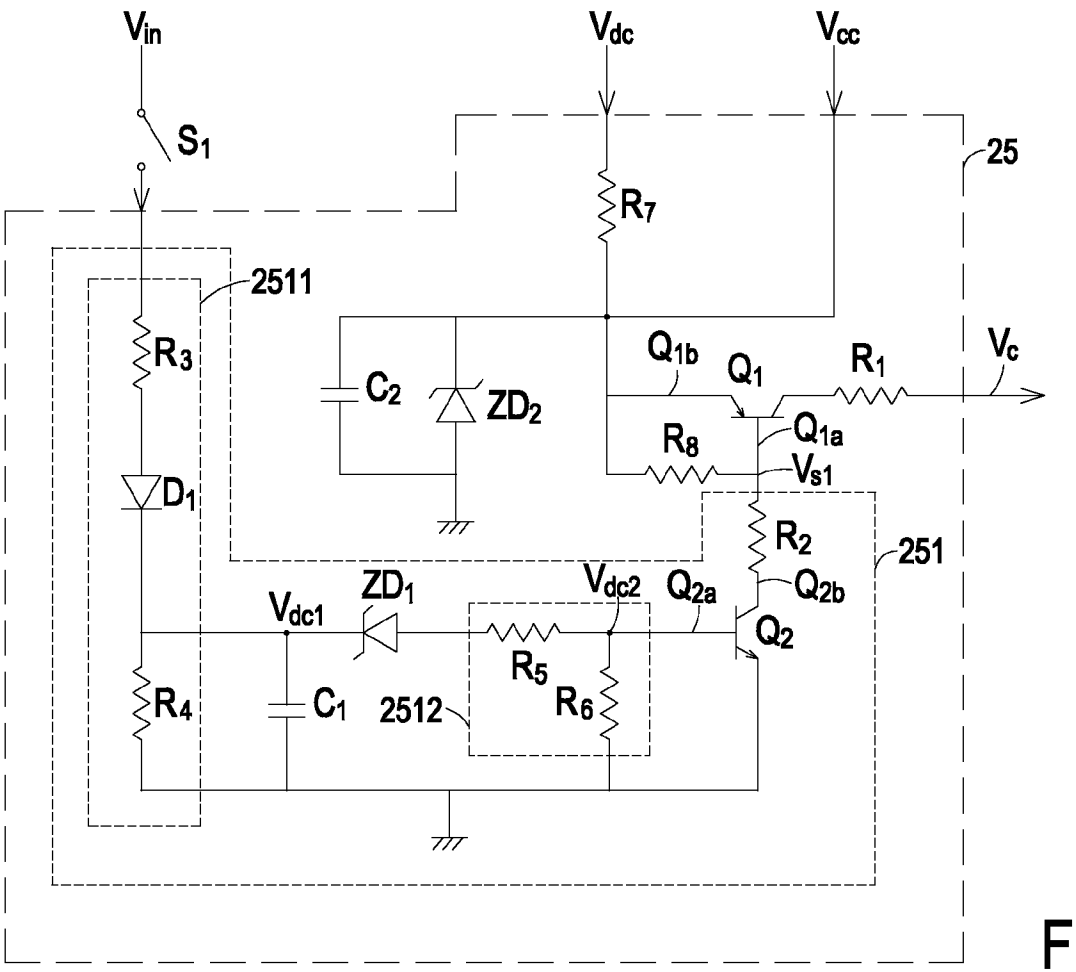
FIG. 2 is a detailed circuit diagram showing the detailed circuitry of the control circuit of the multi-output electronic ballast according to an exemplary embodiment of the invention.

Referring to FIG. 2 and FIG. 1, in which FIG. 2 is a detailed circuit diagram showing the detailed circuitry of the control circuit of the multi-output electronic ballast according to an exemplary embodiment of the invention. As shown in FIG. 2, the control circuit 25 includes a detector 251, a first switch element Q1, and a first resistor R1. The detector 251 is connected to the control terminal Q1*a* of the first switch element Q1 and the first switch S1 for driving the first switch element Q1 to turn on or off according to the ON/OFF state of the first switch S1. The first switch element Q1 is connected to the auxiliary voltage generator 24 and connected to the first inverter controller 221 through the first resistor R1. In this embodiment, the detector 251 includes a voltage dividing and rectifying circuit 2511, a first capacitor C1, a first zener diode ZD1, a first voltage divider 2512, a second switch element Q2, and a second resistor R2. The voltage dividing and rectifying circuit 2511 is connected to the first switch S1. The cathode of the first zener diode ZD1 is connected to the voltage dividing and rectifying circuit 2511 and one end of the first capacitor Cl. The anode of the first zener diode ZD1 is connected to the first voltage divider 2512. The first voltage divider 2512 is connected between the first zener diode ZD1 and the control terminal Q2*a* of the second switch element Q2. The current input terminal Q2*b* of the second switch element Q2 is connected to the control terminal Q1*a* of the first switch element Q1 through the second resistor R2.

In this embodiment, the voltage dividing and rectifying circuit 2511 includes a third resistor R3, a fourth resistor R4, and a first diode Dl. The third resistor R3, the first switch S1, and the first diode D1 are connected in series with each other for dividing and rectifying the AC input voltage Vin which is transmitted through the first switch S1. Therefore, a first DC voltage Vdc1 is generated on the first capacitor C1. The zener diode ZD1 is used to determine if the level of the first DC voltage Vdcl is larger than a threshold level of 10V to turn on the zener diode ZD1. The zener diode D1 does not turn on until the first capacitor C1 is charged to promote the first DC voltage Vdc1 to be larger than the threshold level.

The first voltage divider 2512 includes a fifth resistor R5 and a sixth resistor R6. The fifth resistor R5 is connected between the first zener diode ZD1 and the control terminal Q2*a* of the second switch element Q2. The sixth resistor R6 is connected to the fifth resistor R5 and the control terminal Q2*a* of the second switch element Q2. When the first zener diode ZD1 is turned on, the first voltage divider 2512 divides the first DC voltage Vdcl through the fifth resistor R5 and the sixth resistor R6 to generate a second DC voltage Vdc2. The second DC voltage Vdc2 drives the second switch element Q2 to turn on to allow the detector 251 to output a switching signal Vs1 with a low level. In this embodiment, the switching signal Vs1 is relatively lower than the DC voltage Vdc and the auxiliary voltage Vcc, and thus the first switch element Q1 is turned on. In this embodiment, the control circuit 25 further includes a current-limiting seventh resistor R7 which is connected to the current-inputting terminal Q1*b* of the first switch element Q1 and the DC bus 20. When the first switch element Q1 is turned on, the DC voltage Vdc and the auxiliary voltage Vcc are transmitted to the first inverter controller 221 through the first switch element Q1, thereby generating a control signal Vc and outputting the control signal Vc to the first inverter controller 221 to allow the first lamp assembly 31 to illuminate.

When the first switch S1 is turned on to drive the first switch element Q1 to turn on, the energy of the control signal Vc may be supplied by the auxiliary voltage Vcc. In this manner, the first inverter 22 may output the first AC voltage Vo1. The auxiliary voltage generator 24 may generate the auxiliary voltage Vcc by using the energy of the second AC voltage Vo2 or the DC voltage Vdc. When the circuit start operating and the level of the auxiliary voltage Vcc is insufficient, the first inverter controller 221 may not be provided with enough energy to operate. In alternative embodiments, when the first inverter 22 is stabilized, the energy of the control signal Vc may be supplied by the DC voltage Vdc and the auxiliary voltage Vcc. In other words, when the level of the auxiliary voltage Vcc is insufficient, the energy of the DC voltage Vdc is transmitted to the first inverter controller 221 through the first switch element Q1. This is, the energy of the control signal Vc is supplied by the DC voltage Vdc. Next, after the level of the auxiliary voltage Vcc is promoted to a sufficient value, the energy of the auxiliary voltage Vcc is transmitted to the first inverter controller 221 through the first switch element Q1. That is, the energy of the control signal Vc is supplied by the auxiliary voltage Vcc. In this embodiment, the control circuit 25 further includes a second zener diode ZD2 and a second capacitor C2, in which the second zener diode ZD2 is connected to the current input terminal Q1*b* of the first switch element Q1 for preventing the level of the control signal Vc from being excessive. The second capacitor C2 is connected to the current input terminal Ql*b* of the first switch element Q1 for filtering and retaining the energy required by the control signal Vc. When the first switch S1 is turned on to start the operation of the circuit and the level of the auxiliary voltage Vcc is insufficient, the energy of the control signal Vc may be supplied by the DC voltage Vdc and the second capacitor C2. In this manner, the declining rate of the level of the control signal Vc can be reduced. Next, when the level of the auxiliary voltage Vcc is sufficient, the energy of the control signal Vc is supplied by the auxiliary voltage Vcc. In this embodiment, the control circuit 25 further includes an eighth resistor R8 which is connected between the control terminal Ql*a* and the current input terminal Q1*b* of the first switch element Q1 for preventing the faulty operation of the first switch element Q1 as a result of noises and interferences.

Figure 3:
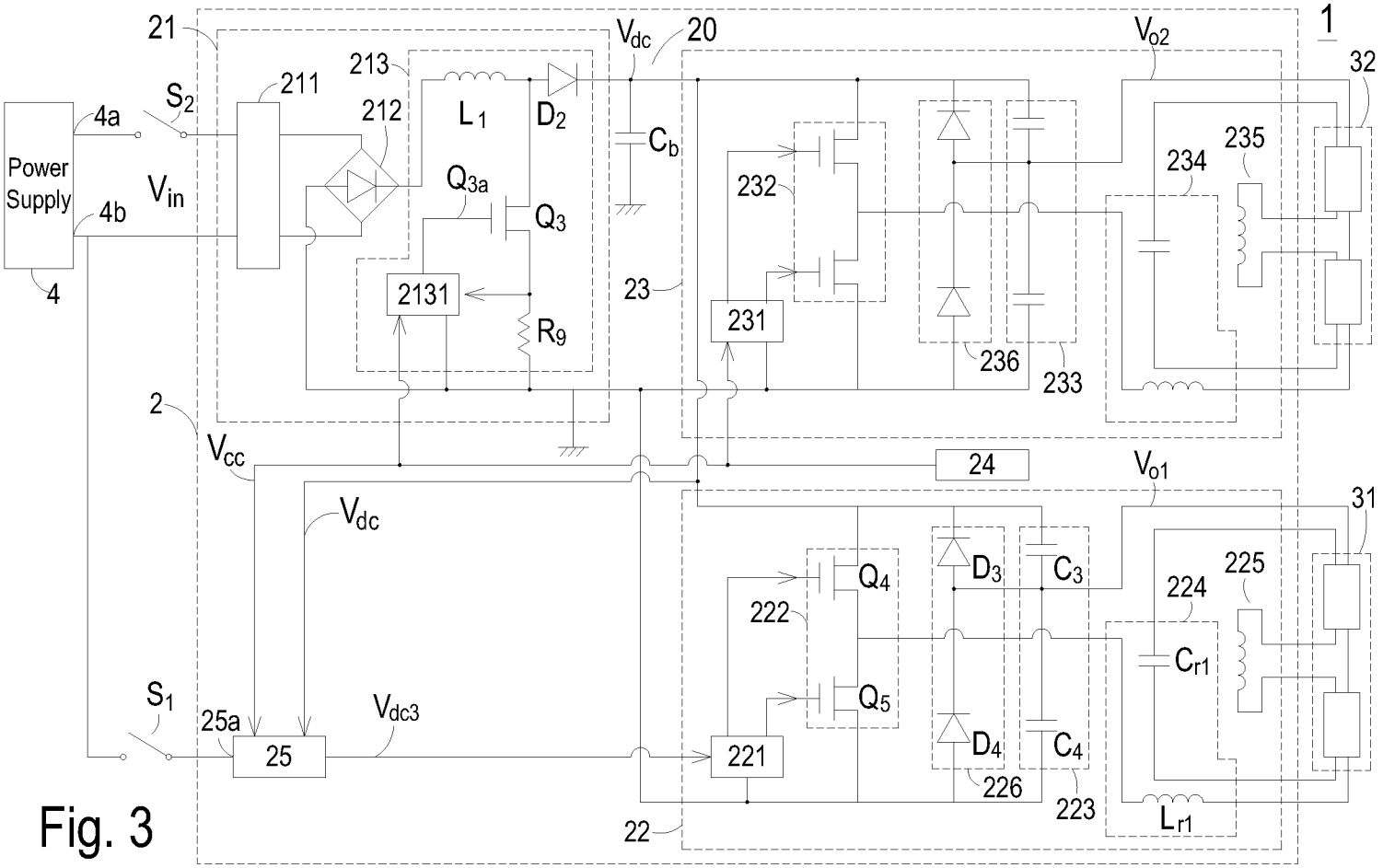
FIG. 3 is a detailed circuit diagram showing the detailed circuitry of the multi-output electronic ballast according to an exemplary embodiment of the invention.

Referring to FIG. 3 and FIG. 1, in which FIG. 3 is a detailed circuit diagram showing the detailed circuitry of the multi-output electronic ballast according to an exemplary embodiment of the invention. As shown in FIG. 3, the AC/DC converter 21 includes an electromagnetic interference filter 211, a rectifier 212, and a power factor correction circuit 213. The electromagnetic interference filter 211 is connected to the second switch S2 and the AC side of the rectifier 212. The DC side of the rectifier 212 is connected to the input side of the power factor correction circuit 213. The output side of the power factor correction circuit 213 is connected to the DC bus 20.

In this embodiment, the power factor correction circuit 213 includes a power factor correction controller 2131, a first inductor L1, a second diode D2, a ninth resistor R9, and a third switch element Q3. One end of the first inductor L1 is connected to the DC side of the rectifier 212 and the other end of the first inductor L1 is connected to the anode of the second diode D2. The cathode of the second diode D2 is connected to the DC bus 20. The third switch element Q3 is connected to the ninth resistor R9, the first inductor L1, and the second diode D2. The power factor correction controller 2131 is connected to the control terminal Q3*a* of the third switch element Q3, and is configured to control the switching operation of the third switch element Q3 in order to allow the current waveform of the AC input current Iin to be analogous to the sinusoidal waveform of the AC input voltage Vin. In this manner, the power factor of the AC input current Tin is promoted. The electromagnetic interference filter 211 is used to block the high-frequency noises of the multi-output electronic ballast 2 and the noises resulted from the AC input voltage Vin, thereby preventing the occurrences of the crossover effect.

In this embodiment, the first inverter 22 includes a first inverter controller 221, a first switch circuit 222, a second voltage divider 223, and a first resonant circuit 224. The first inverter controller 221 is connected to the control circuit 25 and the first switch circuit 222 for controlling the operation of the first switch circuit 222. The second voltage divider 223 is connected to the DC bus 20 for generating a fractional voltage (Vdc/2). The first resonant circuit 224 includes a first resonant inductance Lrl and a first resonant capacitance Cr 1 which are connected in series to form a series resonant circuit for generating a resonant response. When the first switch S1 and the second switch S2 are turned on at the same time, the AC/DC converter 21 converts the AC input voltage Vin into a DC voltage Vdc. The control circuit 25 outputs a control signal Vc with a low level to the first inverter controller 221. In the meantime, the first inverter controller 221 controls the operation of the first switch circuit 222 to allow the energy of the DC voltage Vdc to be selectively outputted to the first resonant circuit 224 through the first switch circuit 222.

In this embodiment, the first switch circuit 222 includes a fourth switch element Q4 and a fifth switch element Q5. The fourth switch element Q4 and the fifth switch element Q5 are connected in series with each other. The second voltage divider 223 a third capacitor C3 and a fourth capacitor C4. The third capacitor C3 and the fourth capacitor C4 are connected in series with each other. The first inverter 22 is able to convert the DC voltage Vdc into a high-frequency first AC voltage Vol by alternately turning on and off the fourth switch element Q4 and the fifth switch element Q5 and the resonant response of the first resonant circuit 224. In this embodiment, the first inverter 22 further includes a first pre-heating winding 225. The first pre-heating winding 225 is, namely, a first pre-heater. The first pre-heater 225 shares the same magnetic core with the first resonant inductance Lrl of the first resonant circuit 224, and is used to pre-heat the first lamp assembly 31.

Besides, the second inverter 23 includes a second inverter controller 231, a second switch circuit 232, a third voltage divider 233, a second resonant circuit 234, and a second pre-heating winding 235. The second pre-heating winding 235 is, namely, a second pre-heater. The connection topology and operating principle of the internal components of the second inverter 23 are similar to the connection topology and operating principle of the internal components of the first inverter 22, and it is not intended to dwell upon the connection topology and operating principle of the internal components of the second inverter 23 herein. However, the power source of the second inverter controller 231 comes from the auxiliary voltage Vcc generated by the auxiliary voltage generator 24. Therefore, the second inverter 23 may start operating as the second switch S2 is turned on.

In this embodiment, the first and second inverters 22 and 23 further include a first protection circuit 226 and a second protection circuit 236. The protection circuits 226 and 236 are used to protect the multi-output electronic ballast 2 when the first lamp assembly 31 or the second lamp assembly 32 is malfunctioned. Next, the first lamp assembly 31 will be taken as an example to illustrate the function of the protection circuit. The first protection circuit 226 includes a third diode D3 and a fourth diode D4 that are connected to the second voltage divider 223. When the first lamp assembly 31 is malfunctioned, the discharging of the first lamp assembly 31 is not symmetrical during the positive and negative cycles of the first AC input voltage Vol. For example, the first lamp assembly 31 only discharges in the positive cycles. In the case that the first protection circuit 226 is not connected, either the voltage value of the third capacitor C3 or the voltage of the fourth capacitor C4 will be excessive. For example, either the voltage value of the third capacitor C3 or the voltage of the fourth capacitor C4 will be high than the DC voltage Vdc. When the voltage of the fourth capacitor C4 is higher than the DC voltage Vdc, the third diode D3 is turned on to prevent the fourth capacitor C4 from being charged and prevent the voltage of the fourth capacitor C4 from damaging the fourth capacitor C4 Likewise, the internal configuration and operation principle of the second protection circuit 236 are similar to those of the first protection circuit 226, and it is not intended to dwell upon the internal configuration and operation principle of the second protection circuit 236.

In conclusion, the invention provides a multi-output electronic ballast which includes an AC/DC converter and is used to control the operation of the internal inverters by a control circuit. Unlike the conventional multi-output electronic ballast which includes a plurality of AC/DC converters, the inventive multi-output electronic ballast can save the manufacturing cost of the electronic ballast. More advantageously, the control circuit of the electronic ballast is simple and small. Overall, when the user turns off the first switch, the control circuit may cease the operation of the first inverter by stopping the supply of the energy required to operate the first inverter controller, thereby turning off the first lamp assembly.

While the invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the invention which is defined by the appended claims.

What is claimed is:

1. A multi-output electronic ballast for driving a plurality of lamp assemblies, comprising:

an AC/DC converter coupled to an AC power supply to receive an AC input voltage and configured to output a high DC voltage to a DC bus;

a first inverter configured to receive the high DC voltage from the DC bus and to output a high-frequency first AC voltage for driving a first lamp assembly;

a second inverter configured to receive the high DC voltage from the DC bus and to output a high-frequency second AC voltage for driving a second lamp assembly;

an auxiliary voltage generator configured to generate an auxiliary DC voltage; and a control circuit coupled to the AC power supply and configured to output a control DC voltage for controlling the operation of the first inverter based on a state of a first switch, the first switch being connected in series between the control circuit and the AC power supply, wherein the control circuit generates the control DC voltage from one of the high DC voltage from the DC bus or the auxiliary DC voltage when the first switch is closed and does not generate the control DC voltage when the first switch is open.

2. The multi-output electronic ballast according to claim 1 wherein the control circuit includes:

a first switch element having a current input terminal connected to the auxiliary voltage generator, an output terminal over which the control DC voltage is supplied to the first inverter via a first resistor, and a control terminal coupled to the first switch via a detector.

3. The multi-output electronic ballast according to claim 2 wherein the detector includes:

a second resistor connected to the control terminal of the first switch element;

a voltage dividing and rectifying circuit connected to the first switch for dividing and rectifying the AC input voltage and generating a first DC voltage accordingly;

a first capacitor connected to the voltage dividing and rectifying circuit;

a first zener diode connected to the first capacitor and the voltage dividing and rectifying circuit for determining if the level of the first DC voltage is larger than a threshold level;

a first voltage divider connected to the first zener diode for dividing the first DC voltage and generating a second DC voltage accordingly; and a second switch element having a control terminal connected to the first voltage divider and a current input terminal connected to the second resistor.

4. The multi-output electronic ballast according to claim 3 wherein the voltage dividing and rectifying circuit includes:

a third resistor;

a fourth resistor; and a first diode;

wherein the third resistor and the first diode are connected in series with the first switch.

5. The multi-output electronic ballast according to claim 3 wherein the first voltage divider includes:

a fifth resistor connected between the first zener diode and the control terminal of the second switch element; and a sixth resistor connected to the fifth resistor and the control terminal of the second switch element.

6. The multi-output electronic ballast according to claim 2 wherein the control circuit further includes a second zener diode connected to the current input terminal of the first switch element for preventing a level of the control DC voltage from being excessive.

7. The multi-output electronic ballast according to claim 2 wherein the control circuit further includes a second capacitor connected to the current input terminal of the first switch element for retaining energy required for generating the control DC voltage.

8. The multi-output electronic ballast according to claim 2 wherein the control circuit further includes a seventh resistor connected to the current input terminal of the first switch element and the AC/DC converter, such that the high DC voltage is supplied to the control circuit via the seventh resistor.

9. The multi-output electronic ballast according to claim 2 wherein the control circuit further includes an eighth resistor connected to the current input terminal of the first switch element and the control terminal of the first switch element for preventing faulty operations of the first switch element.

10. The multi-output electronic ballast according to claim 1 wherein the first inverter includes:

a first switch circuit connected to the AC/DC converter for receiving the high DC voltage;

a second voltage divider connected to the AC/DC converter for receiving the high DC voltage and for generating a fractional voltage from the high DC voltage;

a first resonant circuit connected to the first switch circuit; and a first inverter controller connected to the first switch circuit and the control circuit, the first inverter controller configured to receive the control DC voltage from the control circuit and control operation of the first switch circuit based on the control DC voltage.

11. The multi-output electronic ballast according to claim 10 wherein the first inverter further includes a first protection circuit connected to the second voltage divider for preventing a level of the fractional voltage from being excessive.

12. The multi-output electronic ballast according to claim 10 wherein the first inverter further includes a first pre-heating circuit for pre-heating the first lamp assembly.

13. The multi-output electronic ballast according to claim 1 wherein the AC/DC converter includes:

an electromagnetic interface filter connected to the first switch;

a rectifier connected to the electromagnetic interface filter; and a power factor correction circuit connected to the rectifier and configured to output the high DC voltage, the power factor correction circuit comprising a power factor correction controller, an inductor, a diode, a resistor, and a switch element.

* * * * *